US009396740B1

(12) United States Patent
Bradley

(10) Patent No.: US 9,396,740 B1
(45) Date of Patent: Jul. 19, 2016

(54) SYSTEMS AND METHODS FOR ESTIMATING PITCH IN AUDIO SIGNALS BASED ON SYMMETRY CHARACTERISTICS INDEPENDENT OF HARMONIC AMPLITUDES

(71) Applicant: THE INTELLISIS CORPORATION, San Diego, CA (US)

(72) Inventor: David C. Bradley, San Diego, CA (US)

(73) Assignee: KnuEdge Incorporated, San Diego, CA (US)

( * ) Notice: Subject to any disclaimer, the term of this patent is extended or adjusted under 35 U.S.C. 154(b) by 3 days.

(21) Appl. No.: 14/502,844

(22) Filed: Sep. 30, 2014

(51) Int. Cl.

| | |
|---|---|
| ***G10L 11/04*** | (2006.01) |
| ***G10L 25/90*** | (2013.01) |
| ***G10L 25/12*** | (2013.01) |
| *G10L 25/15* | (2013.01) |
| *G10L 21/0264* | (2013.01) |
| *G10L 25/00* | (2013.01) |

(52) U.S. Cl.
CPC ..... *G10L 25/90* (2013.01); *G10L 25/12* (2013.01); *G10L 21/0264* (2013.01); *G10L 25/00* (2013.01); *G10L 25/15* (2013.01); *G10L 2025/906* (2013.01)

(58) Field of Classification Search
CPC combination set(s) only.
See application file for complete search history.

(56) References Cited

U.S. PATENT DOCUMENTS 5,261,007 A * 11/1993 Hirsch ..... G06F 17/15 702/75
5,953,696 A * 9/1999 Nishiguchi ..... G10L 21/0364 704/209
6,496,797 B1 * 12/2002 Redkov ..... G10L 19/08 704/220
6,963,833 B1 * 11/2005 Singhal ..... G10L 25/90 704/207
7,286,980 B2 * 10/2007 Wang ..... G10L 19/26 704/205
7,315,812 B2 * 1/2008 Beerends ..... G10L 25/69 704/200
8,219,390 B1 * 7/2012 Laroche ..... G10L 21/0272 704/207
2002/0177994 A1 * 11/2002 Chang ..... G10L 25/90 704/205
2004/0167775 A1 * 8/2004 Sorin ..... G10L 25/90 704/208
2004/0193407 A1 * 9/2004 Ramabadran ..... G10L 25/90 704/207
2005/0091045 A1 * 4/2005 Oh ..... G10L 25/90 704/207
2006/0080088 A1 * 4/2006 Lee ..... G10L 25/90 704/207
2009/0030690 A1 * 1/2009 Yamada ..... G10L 15/1807 704/246
2012/0243707 A1 * 9/2012 Bradley ..... G10L 19/00 381/98

FOREIGN PATENT DOCUMENTS

CN 1538667 A * 10/2004
WO WO 2014130571 A1 * 8/2014 ..... G10L 15/24

OTHER PUBLICATIONS

Translation of CN 1538667 A.*
WO2014130571A1.*

* cited by examiner

*Primary Examiner* — Richard Zhu
(74) *Attorney, Agent, or Firm* — Edell, Shapiro & Finnan, LLC

(57) ABSTRACT

Pitch in audio signals may be estimated based on symmetry characteristics independent of harmonic amplitudes. A magnitude spectrum of an audio signal may be provided. The magnitude spectrum may be partitioned by dividing a frequency axis into equal-sized cells. Individual cells may be centered on corresponding harmonic frequencies of a hypothesized pitch. The magnitude spectrum contained in individual cells may be normalized to have equal mean magnitudes and equal standard deviations. A likelihood that the hypothesized pitch is an actual pitch of the audio signal may be determined based on symmetries of magnitude spectra contained in individual cells.

20 Claims, 8 Drawing Sheets

SYSTEMS AND METHODS FOR ESTIMATING PITCH IN AUDIO SIGNALS BASED ON SYMMETRY CHARACTERISTICS INDEPENDENT OF HARMONIC AMPLITUDES

FIELD OF THE DISCLOSURE

This disclosure relates to estimating pitch in audio signals based on symmetry characteristics independent of harmonic amplitudes.

BACKGROUND

Existing speech- and speaker-recognition technology is typically based on a feature space related to a cepstrum. A cepstrum may result from taking an inverse Fourier transform (IFT) of the logarithm of the power spectrum of a signal. There may be a complex cepstrum, a real cepstrum, a power cepstrum, and/or phase cepstrum. The power cepstrum in particular finds applications in the analysis of human speech, essentially as a smoothed energy profile reflecting the power spectrum without the peaks. Feature vectors may contain values of the power cepstrum at discrete points. Occasionally feature vectors may be extended with a pitch estimate to enhance speaker-specific information. In such cases, pitch may be referred to as a "prosodic" feature, meaning it conditions or nuances the speech. Ironically, if the pitch was known with any accuracy, cepstral features may generally not be used in the first place because harmonic amplitudes would have been used instead. The set of complex harmonic amplitudes may contain most of the information in a voice. The cepstral profile may be described as a crude approximation of this set of amplitudes. But to know the amplitudes, generally speaking, the harmonic frequencies must be known, which means the pitch must be known. The prosodic pitch estimates appended to cepstral vectors may have nowhere near the precision needed to specify the harmonic frequencies.

SUMMARY

One aspect of the disclosure relates to a system configured to estimate pitch in audio signals based on symmetry characteristics independent of harmonic amplitudes. According to some implementations, such independence may be important because co-estimating pitch and amplitudes may lead to bias in both types of estimate. In some implementations, the system may include a computing platform and/or other components. The computing platform may be configured to execute computer program instructions. The computer program instructions may include one or more of a magnitude spectrum component, a partition prediction component, a normalization component, a local frequency domain component, a pitch estimation component, and/or other components.

The magnitude spectrum component may be configured to provide a magnitude spectrum of an audio signal. The magnitude spectrum may be provided based on a Fourier transform, a spectral motion transform, and/or other transforms.

The partition prediction component may be configured to partition the magnitude spectrum by dividing a frequency axis into equal-sized cells. Individual cells may be centered on corresponding harmonic frequencies of a hypothesized pitch. In some implementations, the partition may include between eight and twelve cells, inclusive. Other values for the number of cells may be used. Individual cells may span a range of approximately fifty to 300 Hertz.

The normalization component may be configured to normalize the magnitude spectrum contained in individual cells to have equal mean magnitudes and equal standard deviations. The magnitude spectrum contained in individual cells may be normalized to have mean magnitudes of zero and standard deviations of one.

The local frequency domain component may be configured to define local frequency values such that individual cells have a local frequency domain centered at zero. The normalized magnitude spectrum of a given cell may be compared to its mirror obtained about a vertical line at zero-frequency of the given cell in order to determine a symmetry of the magnitude spectrum in the given cell. The comparison may be based on a product-moment correlation.

The pitch estimation component may be configured to determine a likelihood that the hypothesized pitch is an actual pitch of the audio signal based on symmetries of magnitude spectra contained in individual cells. Determining the likelihood that the hypothesized pitch is the actual pitch of the audio signal may be based on a commonality of shapes of individual magnitude spectra in the cells.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
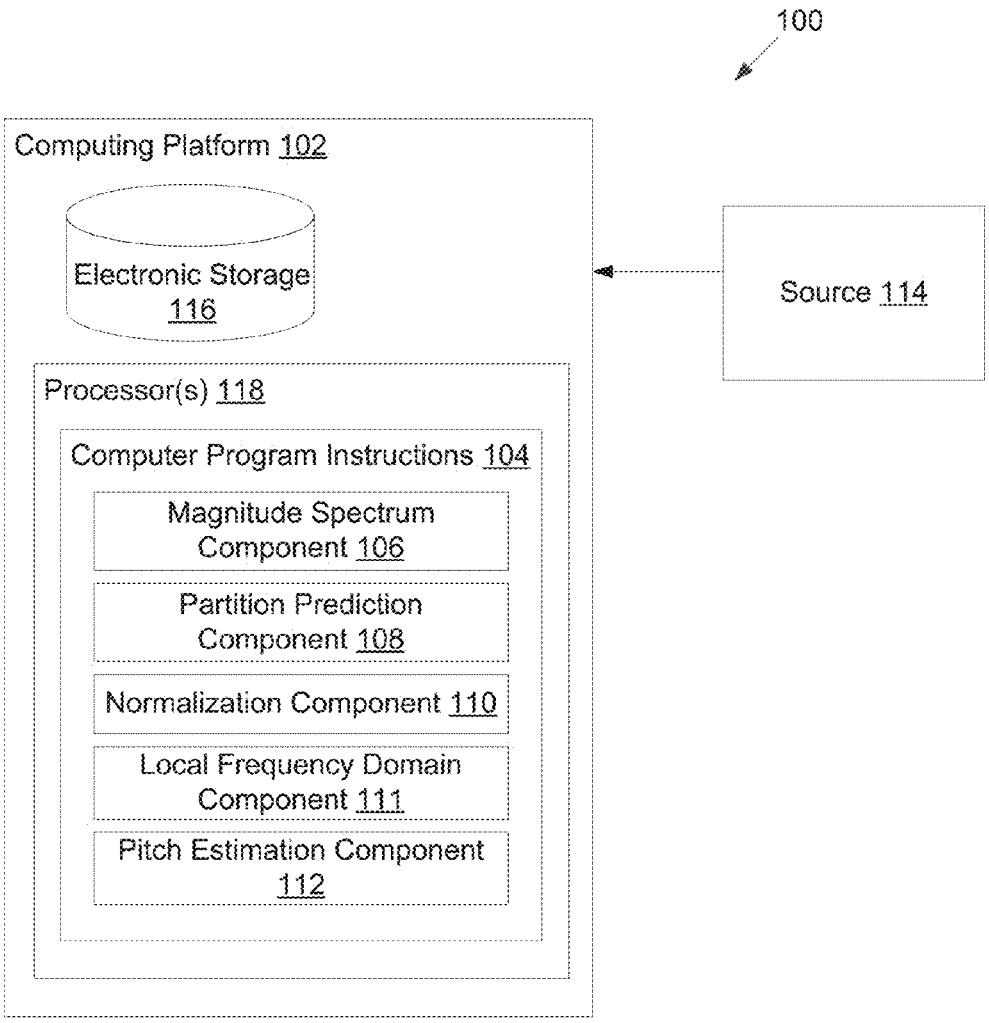
FIG. 1 illustrates a system configured to estimate pitch in audio signals based on symmetry characteristics independent of harmonic amplitudes, in accordance with one or more implementations.

FIG. 1 illustrates a system 100 configured to estimate pitch in audio signals based on symmetry characteristics independent of harmonic amplitudes, in accordance with one or more implementations. There may be two fundamental approaches for estimating pitch. One approach may be based on the discovery of peaks and their corresponding positions on the frequency line. The other approach may be based on the direct measurement of peak spacing—not finding peaks and determining the spacing, but setting up a multi-pronged construct (i.e., a comb) and sensing the simultaneity of evidence at the prongs. The comb approach may be extremely accurate, but it may suffer an ambiguity referred to as the octave problem. The peak approach may suffer no octave problem, but it may suffer from inherent inaccuracies associated with peak detection. Thus, exemplary implementations invoke peak detection to narrow the range of possibilities, and then employ a Dirac comb approach for more precision.

The comb approach in exemplary implementations may not codetermine pitch $\phi$ and amplitude c. Comb techniques for pitch estimation may take many forms, but the underlying mathematical model has generally been the Fourier series. To estimate the fundamental, some evidence may be sought that repeats at some fixed interval. The evidence may be associated with one or more of energy, probability density, magnitude, logic (e.g., on or off), energy and/or magnitude relative to surrounding locations, definition (e.g., information with respect to abscissa), and/or other evidence. The Fourier series, as a model, may predict more than just presence at these frequencies. It may also predict that the object at each frequency is a sinusoid. From this insight, two more predictions may be made.

First, the Fourier transform of a sinusoid is a delta function. Some implementations may use a Gaussian time window, whose Fourier transform is also a Gaussian. Therefore, a given harmonic may be the convolution, in the frequency domain, of a delta and a Gaussian, and thus may be a Gaussian. Individual harmonics may be predicted as being symmetric about corresponding center frequencies. According to some implementations, complex data may be converted to magnitudes, so all values are positive. Now, if all harmonics are normalized to the same amplitude scale, they may look the same: a fixed-amplitude version of the transform of the time window.

The second prediction may be that the harmonics should be interchangeable. That is, any operation on the spectrum as a whole (i.e., the harmonics as a set) may evaluate the same regardless of how the harmonics are arranged. These predictions may not reflect reality, but they are testable, nontrivial predictions. It may be possible to construct a series with wave components at evenly-spaced frequencies, for which none of the above predictions apply.

In some implementations, system 100 may include a computing platform 102 and/or other components. By way of non-limiting example, computing platform 102 may include a mobile communications device such as a smart phone, according to some implementations. Other types of computing platforms are contemplated by the disclosure, as described further herein. The computing platform 102 may be configured to execute computer program instructions 104. The computer program instructions 104 may include one or more of a magnitude spectrum component 106, a partition prediction component 108, a normalization component 110, a local frequency domain component 111, a pitch estimation component 112, and/or other components.

The magnitude spectrum component 106 may be configured to provide a magnitude spectrum of an audio signal. A magnitude spectrum may be expressed as:

$$m(\omega)=|\hat{x}(\omega)| \qquad \text{EQN. 1}$$

where x(t) is the audio time series and $\hat{x}(\omega)$ is its Fourier transform. In some implementations, instead of the Fourier transform, the magnitude spectrum may be provided based on a spectral motion transform and/or other transforms. Examples of spectral motion transforms are described in U.S. patent application Ser. No. 13/205,424 filed on Aug. 8, 2011 and entitled "SYSTEM AND METHOD FOR PROCESSING SOUND SIGNALS IMPLEMENTING A SPECTRAL MOTION TRANSFORM," which is incorporated herein by reference.

The partition prediction component 108 may be configured to partition the magnitude spectrum by dividing a frequency axis into equal-sized cells. Individual cells may be centered on corresponding harmonic frequencies of a hypothesized pitch. According to various implementations, the cells may number between eight and twelve cells, inclusive. However, other amounts of cells may be used. The cells may span a range encompassing approximately fifty to 300 Hertz—the range of the human voice.

In a maximum-likelihood analysis, pitch may be treated as a hypothesis, sweeping it across values, in each case predicting something specific, then determining the probability that the prediction was compatible with the data. The prediction may begin with the harmonic frequencies, followed by something expected to happen at these frequencies (e.g., large amplitude). Exemplary implementations may, instead, predict a partition because what events occur at harmonic frequencies may be inconsequential for many purposes.

Some implementations may define $\Phi=\{\phi_k \in \mathbb{R}_+\}_{K=1}^{K}$, as an indexed set of hypotheses. Individual hypotheses may be a different pitch. The hypotheses may span the human range of approximately fifty to 300 Hertz. The increments may be small. In some implementations, $\Delta\phi=0.2$ Hz. A given hypothesis $\phi_k$ may define a partition as $$\pi=[(p-\tfrac{1}{2})\phi_k,(p-\tfrac{1}{2})\phi_k),p=1,2,\ldots,P \qquad \text{EQN. 2}$$

where P is the number of partitions to be established. The partitions may divide the frequency axis into equal-size cells. Individual cells may be centered on one of the predicted harmonic frequencies.

Within individual cells, the magnitudes may be z-scored, such as by:

$$z_j = \frac{m_j - \overline{m}}{\sigma} \qquad \text{EQN. 3}$$

where $z_j$ is the score of the $j^{th}$ value in the cell, $\overline{m}$ is the mean, and $\sigma$ is the standard deviation for the cell.

The normalization component 110 may be configured to normalize the magnitude spectrum contained in individual cells to have equal mean magnitudes and equal standard deviations. The magnitude spectrum contained in individual cells may be normalized to have mean magnitudes of zero and standard deviations of one, so the cells are normalized to scale.

The local frequency domain component 111 may be configured to define local frequency values such that individual cells have a local frequency domain centered at zero. The normalized magnitude spectrum of a given cell may be compared to its mirror obtained about a zero-frequency line of the given cell in order to determine a symmetry of the magnitude spectrum in the given cell. The comparison may be based on a product-moment correlation.

According to some implementations, local frequency values for the cells may be defined such that:

$$w_j=\omega_j-p\phi_k \quad \text{EQN. 4}$$

which may cause each cell to have a local frequency domain centered at zero. Individual harmonics may therefore be defined as:

$$h_p=\begin{bmatrix}(w_1, z_{p1})\\(w_2, z_{p2})\\\vdots\\(w_j, z_{pj})\\(w_m, z_{pm})\end{bmatrix} \quad \text{EQN. 5}$$

where z is the $j^{th}$ magnitude of the $p^{th}$ harmonic under a given pitch hypothesis. The mirror image of the $p^{th}$ harmonic may be expressed as:

$$h'_p\begin{bmatrix}(w_m, z_{p1})\\(w_{m-1}, z_{p2})\\\vdots\\(w_2, z_{pj})\\(w_1, z_{pm})\end{bmatrix} \quad \text{EQN. 6}$$

That is, the order of the coupling between frequencies and magnitudes may simply be reversed. This mirror image may create a "new" harmonic in the sense of an observation to be compared with a nontrivial model prediction—namely that the mirror image transformation should not change the harmonic shape. This is a consequence of the symmetry of the model with respect to each harmonic.

Because individual harmonics may be normalized to the same magnitude scale, and their respective frequency domains may be centered, a given harmonic definition $\hat{x}_p(w_j)$ may be entirely local. Individual harmonics may be effectively encapsulated. Therefore, notation for global and local frequency variables may be unnecessary. Instead, the harmonic function $\hat{x}_p(w_j)$ may be abbreviated as $\hat{x}_p$. For the correlations discussed below, the original harmonics may not be distinguished from the mirror images.

Any two functions $\hat{x}_i$ and $\hat{x}_j$ may be compared with a product-moment correlation, which may be defined for a population as:

$$\rho=\frac{E[(x_i-\bar{x}_i)(x_j-\bar{x}_j)]}{\sigma_i\sigma_j} \quad \text{EQN. 7}$$

where i and j denote two different partition cells. For a sample, ρ may be estimated as:

$$r=\frac{x_i^T x_j}{n-1} \quad \text{EQN. 8}$$

where $x_i^T$ is the transpose of vector $x_i$ and n is the number of points in each vector.

Given a total of P $\hat{x}_p$, functions plus P mirror images, the total number of non-redundant correlations possible may be $N_p=P^2$. In implementations involving twelve partitions, there may be 144 coefficients. Individual coefficients may be "symmetric" in the sense of meaning the same thing regardless of position. That is, small-amplitude harmonics do not count less and harmonics at high frequencies do not pull harder.

The pitch estimation component 112 may be configured to determine a likelihood that the hypothesized pitch is an actual pitch of the audio signal based on symmetries of magnitude spectra contained in individual cells. Determining the likelihood that the hypothesized pitch is the actual pitch of the audio signal may be based on a commonality of shapes of individual magnitude spectra in the cells.

Indeed, a final pitch estimate may not depend so much on the shape of the harmonics as it does the commonality of shape. As such, in some implementations, each harmonic of interest may be correlated with every other harmonic of interest, along with the mirror images. According to a Fourier series model, correlation operations may not make any difference. To the extent that they do, the model may be failing. For example, correlation operations may make a difference, and the model predictions may fail, responsive to the ϕ value inserted in EQN. 4 being far from the true value. Some implementations may involve a maximum-likelihood (ML) approach. A measure of success may be assigned to each ϕ hypothesis. The most successful hypothesis may be chosen to be the pitch. An ML estimator may be based on a probabilistic measure of success.

For a single correlation coefficient $r_j$, the Fisher transformation may be expressed as:

$$F(r_j)=\frac{1}{2}\log\left(\frac{1+r_j}{1-r_j}\right) \quad \text{EQN. 9}$$

Figure 2:
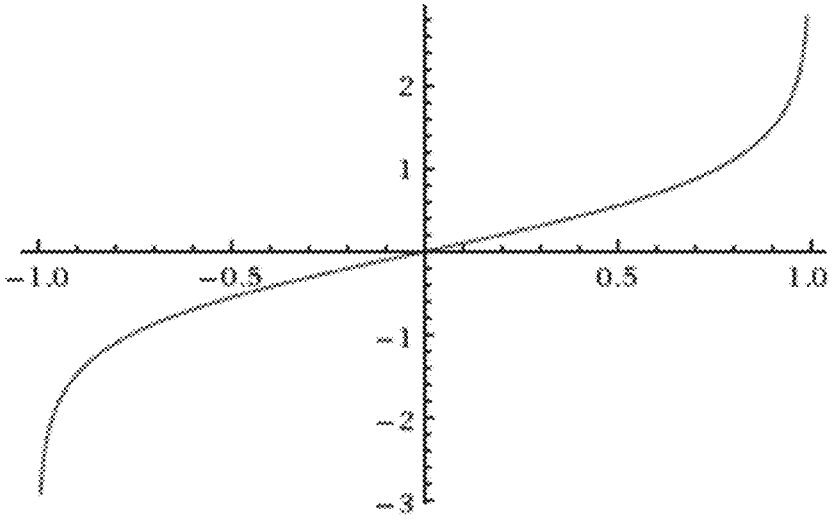
FIG. 2 illustrates a Fisher score associated with exemplary implementations.

The Fisher transformation may be Gaussian distributed with standard error $SE=1/\sqrt{n-3}$. The Fisher score (i.e., the output of the Fisher transformation) may be approximately linear with r over most of the ±1 range (see, e.g., FIG. 2). The derivative $$\frac{dF(r)}{dr}=\frac{1}{1-x^2} \quad \text{EQN. 10}$$

may be within 10% of the value one whenever $|r|\leq 0.3$. The value of $|r|$ may rarely exceed 0.1. Thus, the Fisher transformation may be approximated as $F(r)\approx r$. In such a case, the probability density of r may be approximated as:

$$f(r)\approx\sqrt{\frac{n-3}{2\pi}}\,e^{-\frac{1}{2}(n-3)r^2} \quad \text{EQN. 11}$$

Determining the density $f(r_c)$ for every correlation $r_c$, c=1, 2, . . . , $P^2$, the overall probability may be expressed as:

$$f(\{r_1, r_2, \ldots, r_{P^2}\}) = \prod_{c=1}^{P^2} f(r_c) \quad \text{EQN. 12}$$

This equality may hold only for uncorrelated $r_c$'s. This may be justified because the scales have been normalized, so amplitude trends along the frequency dimension would not be preserved.

Because the r values $\{r_1, r_2, \ldots, r_{P^2}\}$ are themselves functions of the data, instead of $f(\{r_1, r_2, \ldots, r_{P^2}\})$, the function $f(X)$ may be used, where X represents the fixed set of observations at hand, i.e., the set from which all measures such as rare determined. It should be noted that $f(X)$ depends specifically on the pitch hypothesis $\phi$ used to define the partition, as this is what gives rise to the harmonic functions $\hat{x}_p$ that may be cross-correlated.

The probability density of the data, given the parameter $\phi$ at some value, may be indicated as $f_\phi(X)$. The value of this function may be called the likelihood, and may be the same as the value of the likelihood function $L_X(\phi)$. While these functions may produce the same value, they are different functions because the likelihood function sees the data X as a constant parameter, and the likelihood function treats $\phi$ like an independent variable—a changing argument. For individual values of the argument, L may call $f_\phi(X)$ to acquire the likelihood value. The function $f_\phi(X)$ may be determined in two stages. First, the r's may be derived from the raw data X in a way parameterized by the pitch hypothesis, such as:

$$X \xrightarrow{\phi} \{r_1, r_2, \ldots, r_{P^2}\} \quad \text{EQN. 13}$$

The second stage of determining the function $f_\phi(X)$ may be expressed as:

$$f_\phi(X) = \prod_{c=1}^{P^2} f(r_c) = L_X(\phi) \quad \text{EQN. 14}$$

The probability determination of EQN. 11 may be with respect to a null hypothesis distribution with mean zero and standard error $(n-3)^{-1/2}$. And yet, when a pitch hypothesis $\phi$ is accurate, r values may be expected to move away from zero. Thus, when $\phi$ approaches the true value, the likelihood L may start to fall, not rise. This may cause the function $L_X(\phi)$ to reach a minimum, not a maximum, when $\phi$ aligns with the true pitch. This may be viewed as a technicality; the nadir may be singular and may accurately signal the pitch. The area under $L_X(\phi)$ versus may be normalized to unity. This may be achieved by dividing by the negative of the area.

Likelihoods may be converted to log-likelihoods as:

$$L_X(\phi) = \prod_{c=1}^{P^2} f(r_c) \quad \text{EQN. 15}$$

$$\log L_X(\phi) = \sum_{c=1}^{P^2} \log f(r_c) \quad \text{EQN. 16}$$

From EQN. 11, it may be approximated that:

$$\log L_X(\phi) \approx \sum_{c=1}^{P^2} \log \sqrt{\frac{n_c - 3}{2\pi}}\, e^{-\frac{1}{2}(n_c-3)r^2} \quad \text{EQN. 17}$$

Thus, it may be written that:

$$\log L_X(\phi) \approx \sum_{c=1}^{P^2} \left\{ \log \sqrt{\frac{n_c - 3}{2\pi}} - \frac{(n_c - 3)}{2} r^2 \right\} \quad \text{EQN. 18}$$

where $r^2$ is the coefficient of determination.

In some implementations, computing platform 102 may be operatively linked via one or more electronic communication links to one or more other components of system 100 (e.g., other computing platforms not depicted). For example, such electronic communication links may be established, at least in part, via a network such as the Internet, a telecommunications network, and/or other networks. It will be appreciated that this is not intended to be limiting, and that the scope of this disclosure includes implementations in which one or more components of system 100 may be operatively linked via some other communication media.

The computing platform 102 may include electronic storage 116, one or more processors 118, and/or other components. The computing platform 102 may include communication lines, or ports to enable the exchange of information with a network and/or other platforms. Illustration of computing platform 102 in FIG. 1 is not intended to be limiting. The computing platform 102 may include a plurality of hardware, software, and/or firmware components operating together to provide the functionality attributed herein to computing platform 102. For example, computing platform 102 may be implemented by two or more communications platforms operating together as computing platform 102. By way of non-limiting example, computing platform 102 may include one or more of a server, desktop computer, a laptop computer, a handheld computer, a NetBook, a Smartphone, a cellular phone, a telephony headset, and/or other computing platforms.

The electronic storage 116 may comprise electronic storage media that electronically stores information. The electronic storage media of electronic storage 116 may include one or both of system storage that is provided integrally (i.e., substantially non-removable) with computing platform 102 and/or removable storage that is removably connectable to computing platform 102 via, for example, a port (e.g., a USB port, a firewire port, etc.) or a drive (e.g., a disk drive, etc.). The electronic storage 116 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storage 116 may include one or more virtual storage resources (e.g., cloud storage, a virtual private network, and/or other virtual storage resources). The electronic storage 116 may store software algorithms, information determined by processor(s) 118, information received from a remote device, information received from source 114, and/or other information that enables computing platform 102 to function as described herein.

The processor(s) 118 may be configured to provide information processing capabilities in computing platform 102. As such, processor(s) 118 may include one or more of a digital processor, an analog processor, a digital circuit designed to process information, an analog circuit designed to process information, a state machine, and/or other mechanisms for electronically processing information. Although processor(s) 118 is shown in FIG. 1 as a single entity, this is for illustrative purposes only. In some implementations, processor(s) 118 may include a plurality of processing units. These processing units may be physically located within the same device, or processor(s) 118 may represent processing functionality of a plurality of devices operating in coordination. The processor(s) 118 may be configured to execute modules 106, 108, 110, 111, 112, and/or other modules. The processor(s) 118 may be configured to execute modules 106, 108, 110, 111, 112, and/or other modules by software; hardware; firmware; some combination of software, hardware, and/or firmware; and/or other mechanisms for configuring processing capabilities on processor(s) 118.

It should be appreciated that although modules 106, 108, 110, 111, and 112 are illustrated in FIG. 1 as being co-located within a single processing unit, in implementations in which processor(s) 118 includes multiple processing units, one or more of modules 106, 108, 110, 111, and/or 112 may be located remotely from the other modules. The description of the functionality provided by the different modules 106, 108, 110, 111, and/or 112 described below is for illustrative purposes, and is not intended to be limiting, as any of modules 106, 108, 110, 111, and/or 112 may provide more or less functionality than is described. For example, one or more of modules 104, 106, 108, 110, 111, and/or 112 may be eliminated, and some or all of its functionality may be provided by other ones of modules 106, 108, 110, 111, and/or 112. As another example, processor(s) 118 may be configured to execute one or more additional modules that may perform some or all of the functionality attributed below to one of modules 106, 108, 110, 111, and/or 112.

Figure 3:
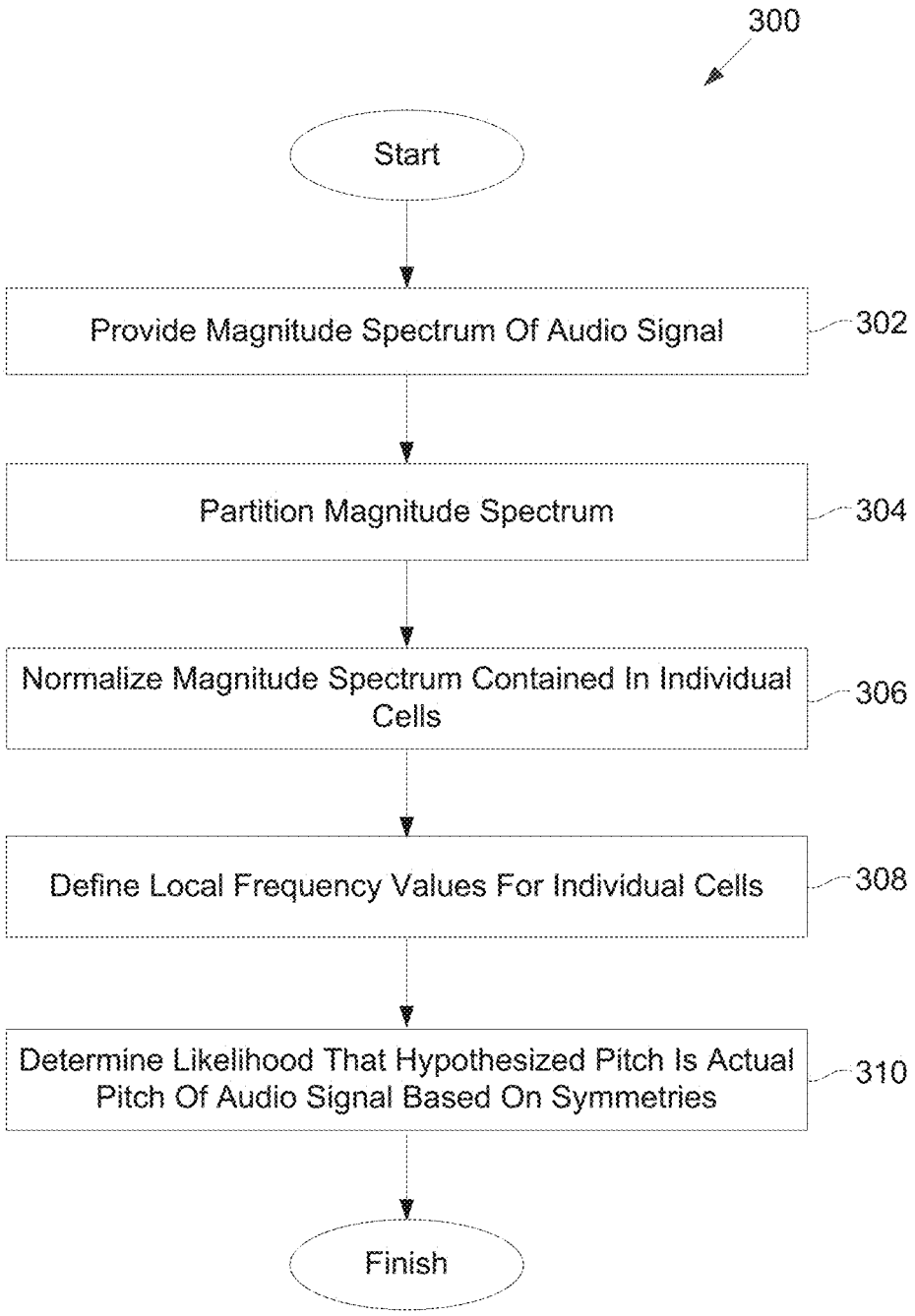
FIG. 3 illustrates a method for estimating pitch in audio signals based on symmetry characteristics independent of harmonic amplitudes, in accordance with one or more implementations.

FIG. 3 illustrates a method 300 for estimating pitch in audio signals based on symmetry characteristics independent of harmonic amplitudes, in accordance with one or more implementations. The operations of method 300 presented below are intended to be illustrative. In some implementations, method 300 may be accomplished with one or more additional operations not described, and/or without one or more of the operations discussed. Additionally, the order in which the operations of method 300 are illustrated in FIG. 3 and described below is not intended to be limiting.

In some implementations, method 300 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 300 in response to instructions stored electronically on an electronic storage medium. The one or more processing devices may include one or more devices configured through hardware, firmware, and/or software to be specifically designed for execution of one or more of the operations of method 300.

Figure 4:
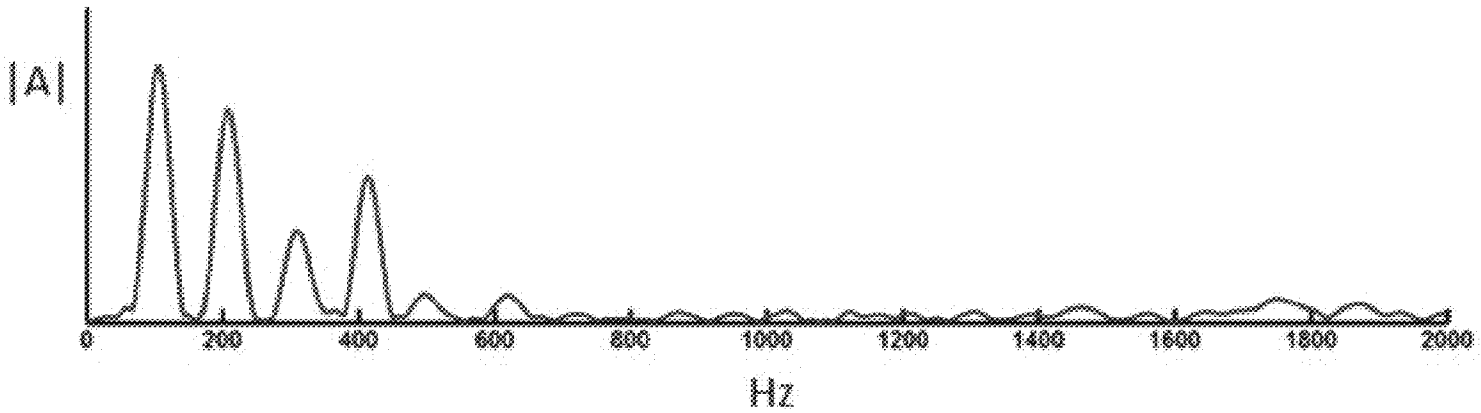
FIG. 4 illustrates an exemplary magnitude spectrum for a male voice pitched at 105 Hz.

At an operation 302, a magnitude spectrum of an audio signal may be provided. FIG. 4 illustrates an exemplary magnitude spectrum for a male voice pitched at 105 Hz. This example was deliberately chosen because a small number of harmonics dominates the spectrum, which is one of the problems that may tend to confound amplitude and pitch. The signal-to-noise ratio is zero decibels with white noise. Operation 302 may be performed by one or more processors configured to execute a magnitude spectrum component that is the same as or similar to magnitude spectrum component 106, in accordance with one or more implementations.

Figure 5A:
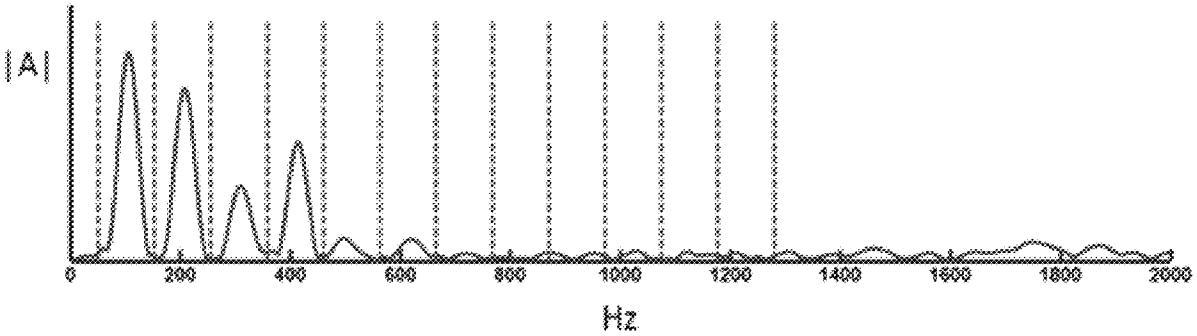
FIG. 5A illustrates the magnitude spectrum of FIG. 4 partitioned under a hypothesis of the pitch being 105 Hertz.
Figure 5B:
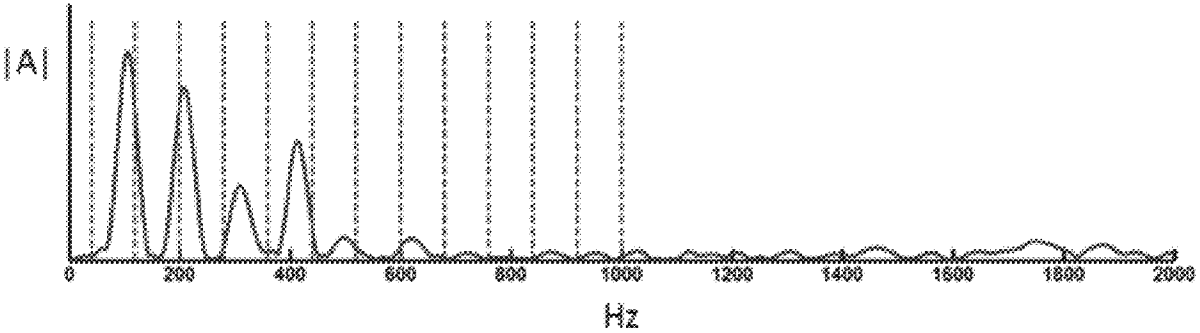
FIG. 5B illustrates the magnitude spectrum of FIG. 4 partitioned under a hypothesis of the pitch being 80 Hertz.

At an operation 304 (see FIG. 3), the magnitude spectrum may be partitioned by dividing a frequency axis into equal-sized cells. Individual cells may be centered on corresponding harmonic frequencies of a hypothesized pitch. FIG. 5A illustrates the magnitude spectrum of FIG. 4 partitioned under a hypothesis of the pitch being 105 Hertz. FIG. 5B illustrates the magnitude spectrum of FIG. 4 partitioned under a hypothesis of the pitch being 80 Hertz. Both FIGS. 5A and 5B show twelve partitions. Operation 304 may be performed by one or more processors configured to execute a partition prediction component that is the same as or similar to partition prediction component 108, in accordance with one or more implementations.

Figure 6:
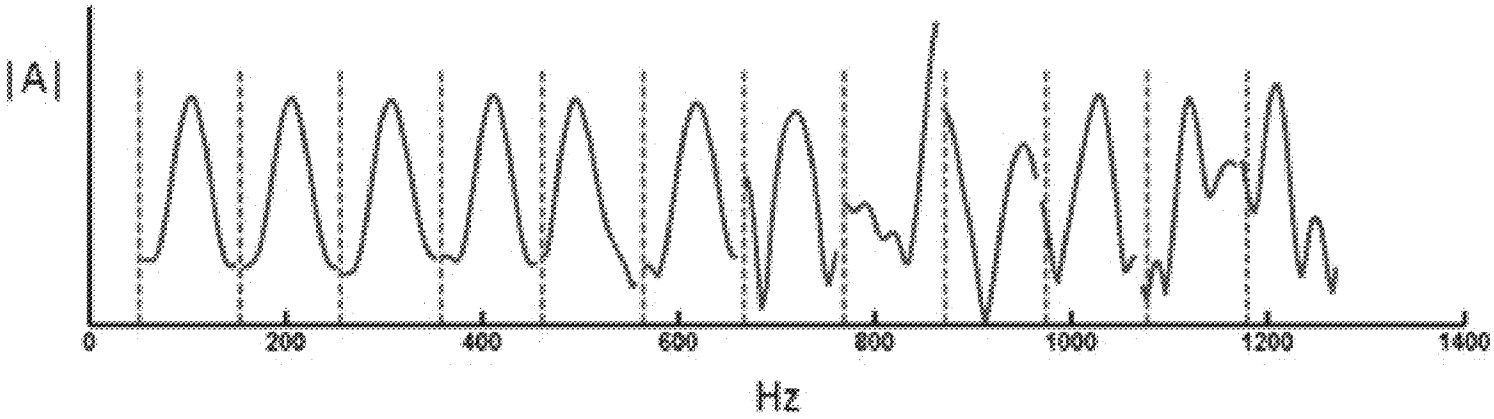
FIG. 6 illustrates the partitioned magnitude spectrum of FIG. 5A with individual cells being normalized such that the mean magnitude is zero and the standard deviation is one.

At an operation 306 (see FIG. 3), the magnitude spectrum contained in individual cells may be normalized to have equal mean magnitudes and equal standard deviations. FIG. 6 illustrates the partitioned magnitude spectrum of FIG. 5A with individual cells being normalized such that the mean magnitude is zero and the standard deviation is one. Operation 306 may be performed by one or more processors configured to execute a normalization component that is the same as or similar to normalization component 110, in accordance with one or more implementations.

At an operation 308 (see FIG. 3), local frequency values may be defined such that individual cells have a local frequency domain centered at zero. Operation 308 may be performed by one or more processors configured to execute a local frequency domain component that is the same as or similar to local frequency domain component 111, in accordance with one or more implementations.

Figure 7A:
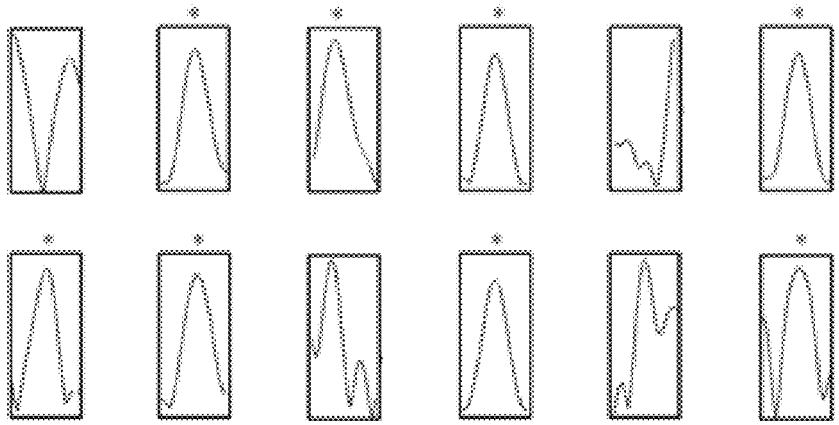
FIG. 7A illustrates individual normalized cells of FIG. 6, separated and positioned randomly.
Figure 7B:
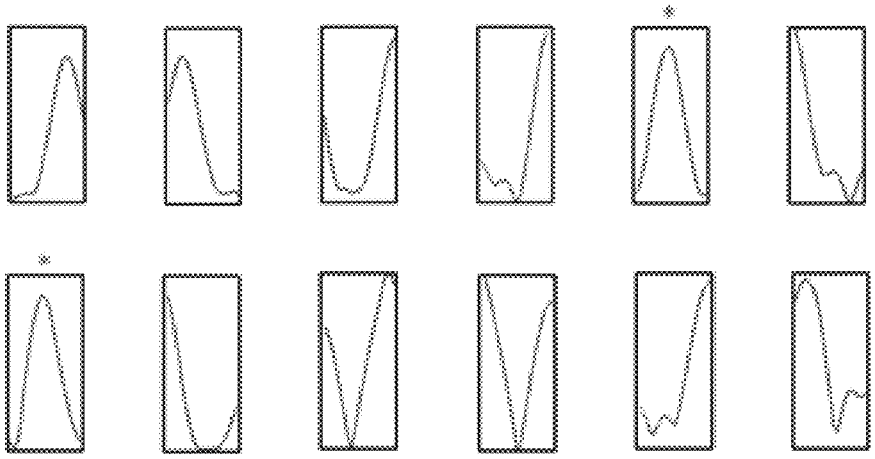
FIG. 7B illustrates individual normalized cells of the magnitude spectrum of FIG. 5B, which is partitioned under a hypothesis of the pitch being 80 Hertz.

At an operation 310, a likelihood that the hypothesized pitch is an actual pitch of the audio signal may be determined based on symmetries of magnitude spectra contained in individual cells. FIG. 7A illustrates individual normalized cells of FIG. 6, separated and positioned randomly. In FIG. 7A, eight of the twelve cells, indicated with asterisks, show a peaked shape, roughly symmetric about the vertical midline. FIG. 7B illustrates individual normalized cells of the magnitude spectrum of FIG. 5B, which is partitioned under a hypothesis of the pitch being 80 Hertz. In FIG. 7B, only two partition cells are peaked and midline-symmetric. Thus, without concern over the height or center frequency of the structures defined in these cells, it is readily apparent that the 105 Hertz set will have better cross-correlations, because the shapes are more consistent. To state the significance more specifically, a maximum-likelihood estimate of the pitch that is independent of amplitude may be determined. As such, the maximum-likelihood estimate may be invariant under a variety of amplitude transformations, including linear distortion and static nonlinearities such as compression. Operation 310 may be performed by one or more processors configured to execute a pitch estimation component that is the same as or similar to pitch estimation component 112, in accordance with one or more implementations.

Figure 8:
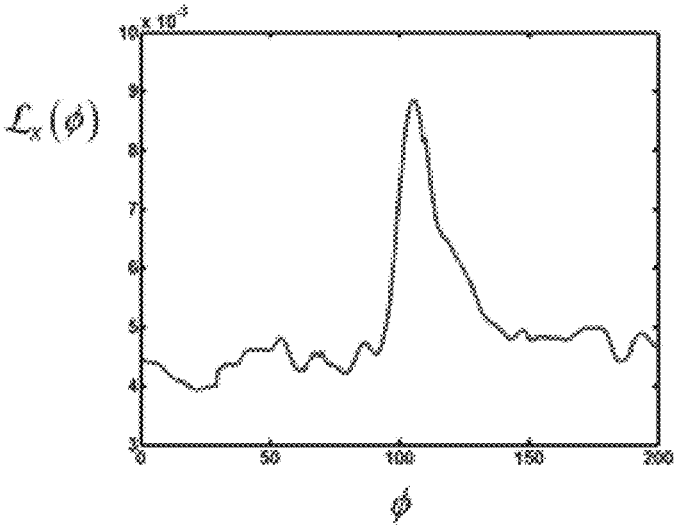
FIG. 8 illustrates an exemplary log-likelihood versus pitch hypothesis relationship associated with the magnitude spectrum of FIG. 4.
Figure 9:
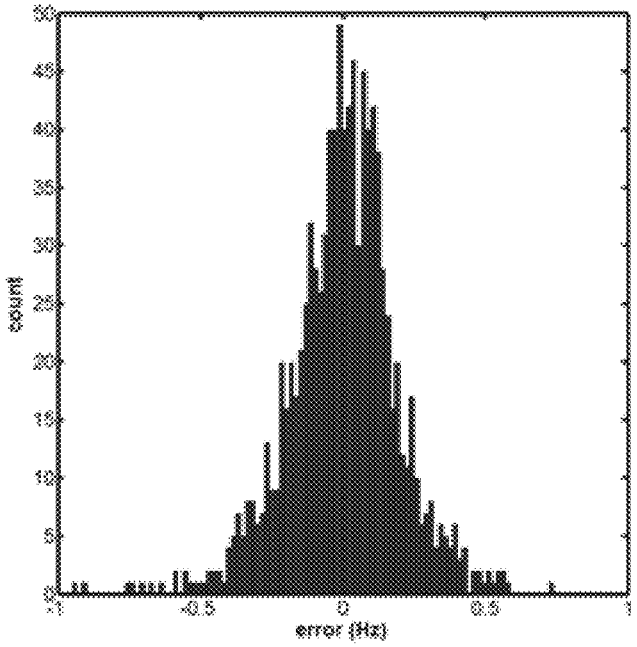
FIG. 9 illustrates an exemplary error from simulated pitch in zero decibels of white noise.

According to some implementations, invariance may be required in an operation associated with mirror imaging, or rotating the harmonic about its vertical midline. That operation is not illustrated in the figures, but the correlation results discussed below are based in all cases on the base set of partition cells and the mirror image of each included as a separate observation. FIG. 8 illustrates an exemplary log-likelihood versus pitch hypothesis relationship associated with the magnitude spectrum of FIG. 4, where the symbol $\mathcal{L}$ denotes the log-likelihood function defined in EQN. 18. Using a bootstrap procedure, the $\mathcal{L}(\phi)$ curve was sampled 1000 times, in each case locating the pitch value beneath the curve maximum. The mean pitch estimate was 105.2 Hertz with standard error 0.68 Hertz, corresponding to a coefficient of variation of about 0.64%. For the same tests with clean (noiseless) data, a bootstrap standard error of 0.15 and a coefficient of variation of 0.12% were achieved. These figures have been confirmed in dynamic voice simulations where the true pitch was known, and 0 dB noise was added. In such cases, the standard error was about 0.1 Hertz when the mean pitch varied between 120 and 140 (see FIG. 9). This corresponds to a coefficient of variation of about 0.08%.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A processor-implemented method for estimating pitch in audio signals based on symmetry characteristics independent of harmonic amplitudes, the method being performed by one or more processors configured to execute computer program instructions, the method comprising:

providing a magnitude spectrum of an audio signal;

partitioning the magnitude spectrum by dividing a frequency axis into equal-sized cells, each cell having a width of a hypothesized pitch and being centered on corresponding harmonic frequencies of the hypothesized pitch;

normalizing the magnitude spectrum contained in individual cells to have equal mean magnitudes and equal standard deviations;

determining a likelihood that the hypothesized pitch is an actual pitch of the audio signal based on symmetries of magnitude spectra contained in individual cells, wherein the symmetries of magnitude spectra are determined based on whether the magnitude spectrum within an individual cell is symmetric about a corresponding center frequency;

repeating the partitioning, normalizing and determining operations for a plurality of hypothesized pitches in addition to the hypothesized pitch;

sampling determined likelihoods for the hypothesized pitch and the plurality of hypothesized pitches to generate a pitch likelihood distribution across the hypothesized pitch and the plurality of hypothesized pitches;

determining an estimated pitch based on a maximum of the sampling;

determining a harmonic amplitude of a voice in the audio signal based on the estimated pitch; and performing speech or speaker recognition using the determined harmonic amplitude of the voice.

2. The method of claim 1, wherein the magnitude spectrum is provided based on a Fourier transform.

3. The method of claim 1, wherein the magnitude spectrum is provided based on a spectral motion transform.

4. The method of claim 1, wherein the cells include between eight and twelve cells, inclusive.

5. The method of claim 1, wherein the cells span a range encompassing approximately fifty to 300 Hertz.

6. The method of claim 1, wherein the magnitude spectrum contained in individual cells is normalized to have mean magnitudes of zero and standard deviations of one.

7. The method of claim 1, further comprising defining local frequency values such that individual cells have a local frequency domain centered at zero.

8. The method of claim 7, wherein the normalized magnitude spectrum of a given cell is compared to its mirror obtained about a zero-frequency line of the given cell in order to determine a symmetry of the magnitude spectrum in the given cell.

9. The method of claim 8, wherein the comparison is based on a product-moment correlation.

10. The method of claim 1, wherein determining the likelihood that the hypothesized pitch is the actual pitch of the audio signal is further based on a commonality of shapes of individual magnitude spectra in the cells.

11. A system configured to estimate pitch in audio signals based on symmetry characteristics independent of harmonic amplitudes, the system comprising:

one or more processors configured to execute one or more computer programs to:

provide a magnitude spectrum of an audio signal;

partition the magnitude spectrum by dividing a frequency axis into equal-sized cells, each cell having a width of a hypothesized pitch and being centered on corresponding harmonic frequencies of the hypothesized pitch;

normalize the magnitude spectrum contained in individual cells to have equal mean magnitudes and equal standard deviations;

determine a likelihood that the hypothesized pitch is an actual pitch of the audio signal based on symmetries of magnitude spectra contained in individual cells, wherein the symmetries of magnitude spectra are determined based on whether the magnitude spectrum within an individual cell is symmetric about a corresponding center frequency:

repeat the partition, normalize and determine operations for a plurality of hypothesized pitches in addition to the hypothesized pitch;

sample determined likelihoods for the hypothesized pitch and the plurality of hypothesized pitches to generate a pitch likelihood distribution across the hypothesized pitch and the plurality of hypothesized pitches;

determining an estimated pitch based on a maximum of the sampling;

determining a harmonic amplitude of a voice in the audio signal based on the estimated pitch; and performing speech or speaker recognition using the determined harmonic amplitude of the voice.

12. The system of claim 11, wherein the magnitude spectrum is provided based on a Fourier transform.

13. The system of claim 11, wherein the magnitude spectrum is provided based on a spectral motion transform.

14. The system of claim 11, wherein the cells include between eight and twelve cells, inclusive.

15. The system of claim 11, wherein the cells span a range encompassing approximately fifty to 300 Hertz.

16. The system of claim 11, wherein the magnitude spectrum contained in individual cells is normalized to have mean magnitudes of zero and standard deviations of one.

17. The system of claim 11, wherein the one or more processors are further configured to execute the one or more computer program modules to define local frequency values such that individual cells have a local frequency domain centered at zero.

18. The system of claim 17, wherein the normalized magnitude spectrum of a given cell is compared to its mirror obtained about a zero-frequency line of the given cell in order to determine a symmetry of the magnitude spectrum in the given cell.

19. The system of claim 18, wherein the comparison is based on a product-moment correlation.

20. The system of claim 11, wherein determining the likelihood that the hypothesized pitch is the actual pitch of the audio signal is further based on a commonality of shapes of individual magnitude spectra in the cells.

* * * * *